United States Patent [19]

Beutler et al.

[11] Patent Number: 5,002,275

[45] Date of Patent: Mar. 26, 1991

[54] METHOD AND APPARATUS FOR SPORT SWING TRAINING

[76] Inventors: Gary J. Beutler, 4590 Oxbow Ridge, Sacramento, Calif. 95628; James E. Schiller, 1697 Rolleston Pl., El Dorado Hills, Calif. 95630

[21] Appl. No.: 518,155

[22] Filed: May 3, 1990

[51] Int. Cl.[5] ..... A63B 69/36; A63B 21/00

[52] U.S. Cl. ..... 273/35 R; 272/116; 273/193 A; 273/26 B; 434/252

[58] Field of Search ..... 272/93, 116, 125; 273/26 R, 26 B, 35 R, 29 A, 183 R, 183 B, 186 R, 186 A, 188 R, 193 A, 194 B; 434/252

[56] References Cited

U.S. PATENT DOCUMENTS

| | | | |
|---|---|---|---|
| 3,109,244 | 11/1963 | Trifano et al. | 273/35 R X |
| 3,463,492 | 8/1969 | White | 273/26 B X |
| 3,606,340 | 9/1971 | Tiller | 273/193 B X |
| 3,809,397 | 5/1974 | Gruenewald | 273/26 B |
| 4,317,567 | 3/1982 | Blake | 273/186 A X |
| 4,603,854 | 8/1986 | Krausz | 272/116 |
| 4,854,585 | 8/1989 | Koch et al. | 273/193 B |

*Primary Examiner*—William H. Grieb

*Attorney, Agent, or Firm*—Flehr, Hohbach, Test, Albritton & Herbert

[57] ABSTRACT

A novel swing training method and apparatus means for perfecting the awareness, dependent swing motion and muscle groups contributing to the performance of players who engage in dependent sport games and activities are disclosed. A blade having sufficient width and rigidity to generate air resistance during a represnetative swing motion is designed to float on the shaft of the appendant training apparatus so as to remain perpendicular to the swing plane throughout said user swing or stroke motion.

4 Claims, 3 Drawing Sheets

METHOD AND APPARATUS FOR SPORT SWING TRAINING

BACKGROUND OF THE INVENTION

The present invention relates to training methods and devices designed to improve the awareness, fitness and skill of users who may be engaged in related sports activity requiring swing motion.

DESCRIPTION OF THE PRIOR ART

Training devices incorporating various mechanical and electronic control means to observe and improve skills relating to player motion for sports such as golf, hockey, tennis, baseball and the like are used throughout the sports community. In particular, a variety of resistance devices have been documented that are used to improve swing motion. However, limitations of the above devices and all prior art teachings intended to improve user skills lack effective means to control the contact and/or full swing motion of the user such as to simulate actual sport activity.

Specifically, a suitable training device has not been developed or described in the prior art for controlling the resistance force imposed on the user during a representative swing motion such as to avoid influencing the spatial plane of the user's swing action, at ball contact, and follow-through.

In the case of training devices designed to improve skills needed for golf, no training devices have been developed or suggested in the prior art that allow the user to counteract wrist or arm motion developed during the swing motion, such as to prevent a change in the resistance of said device during said swing motion. Known devices do not aid in maintaining the ideal plane of said swing motion for repeatability and development of user skills. Prior art devices cause changes in the alignment of the swing relative to the follow-through plane, and tend to carry the simulated stick, racket or bat motion beyond the ideal swing plane, compromising the benefits and repeatability of the training exercise.

All of the training devices developed to date incorporate simple mechanical action means (friction, weights, rubber bands, etc.) to establish resistance to the follow-through motion of said devices during exercises designed to observe and to improve user skills. The use of air resistance is a known cost-effective means to generate said swing resistance.

However, none of the known methods provide for or suggest means for maintaining constant resistance simulating actual play resistance throughout a given swing motion or stroke. Accordingly, continuous change in dependent resistance loading during said swing motion gives a false impression of the power and follow-through action required to control the energy and trajectory of a ball or like object that is to be influenced by said trajectory and dependent ball impact energy transfer.

Moreover, all of the prior art teachings that are used to simulate a full stroke motion use either simulation impact or actual balls to judge the potential energy transfer and technique of the user. Such methods lack the ability to simulate the follow-through resistance and motion of representative ball players. Consequently, all of the methods heretofore developed fail to address (and therefore to perfect) the required awareness and isolation of key muscle groups used to achieve overall swing-motion and dependent skill improvement. These and related limitations of the prior art are corrected by the subject invention.

It is an object of the instant invention described herein to provide means to maintain a constant resistance force throughout a representative swing to increase player awareness of control and style influencing the results of player action.

It is a second object of this invention to provide a low-cost means for isolating certain key muscle groups for exercise and development through which the power and skill of the participant may be observed and improved for the intended sport activity.

It is still another object of this invention to provide means whereby the actual player motion during simulated game play of a sport requiring controlled swing motion may be observed and studied.

It is a final object of this invention to provide means for constructing a low-cost training device whereby the skills of the user may be studied, exercised and improved without the use or need of a ball or like resistance impact.

SUMMARY OF THE INVENTION

The subject invention is a practical means for observing and exercising player swing motion to improve player skill. While suitable for a variety of sports that require controlled swing motion, the exemplary apparatus described herein is especially suited for the game of golf. This example is chosen to simplify the description of features of training apparatus that may be tailored for other specific sports activity using the disclosed teachings. For the exemplary case addressed in this specification, the device is constructed of assembled parts as would occur in low-volume manufacturing. Conversely, depending on the number of units that may be manufactured or offered at one time, molding or stamping to eliminate joining may be used to provide larger component sections that will reduce the number of parts otherwise required for assembly The choice of technique of manufacturing is based on cost effectiveness and reliability.

The method and apparatus disclosed herein improves a golfer's swing and dependent play skill in several ways. Firstly, since the device slows down a golfer's swing (through controlled and constant air resistance) the user becomes much more aware of the basic components of the swing, i.e. the stance, grip, back swing, forward swing, and follow-through. This slowing process allows the individual to develop much greater muscle memory and a better "feel" for the swing motion and follow-through process.

Secondly, the device strengthens the necessary muscle groups that make possible a well-controlled and powerful swing. The adding of resistance throughout the swing motion acts as a substantial muscle builder.

Thirdly, the device offers a constant resistance force with very low inertia and counter forces. This is in contrast to conventional practice devices that most often employ weights or elastic cords, achieving less benefit. The most natural way to simulate a normal golf swing and still reap the benefits outlined above is by maintaining a constant resistance force throughout the user's swing and full stroke motion. A unique and critical feature of the invention described herein is the use of a floating blade and alignment means whereby the resistance acting against said user's swing motion is always constant. The device increases the required muscle power to complete a representative player stroke, thereby providing an exercise that builds key muscle groups with repetitive play action. Interdependent features of the construction and design of the device described herein differentiate the approach and total benefit(s) of this device from the capability of the devices taught in prior art.

DESCRIPTION OF A PREFERRED EMBODIMENT

Figure 1A:
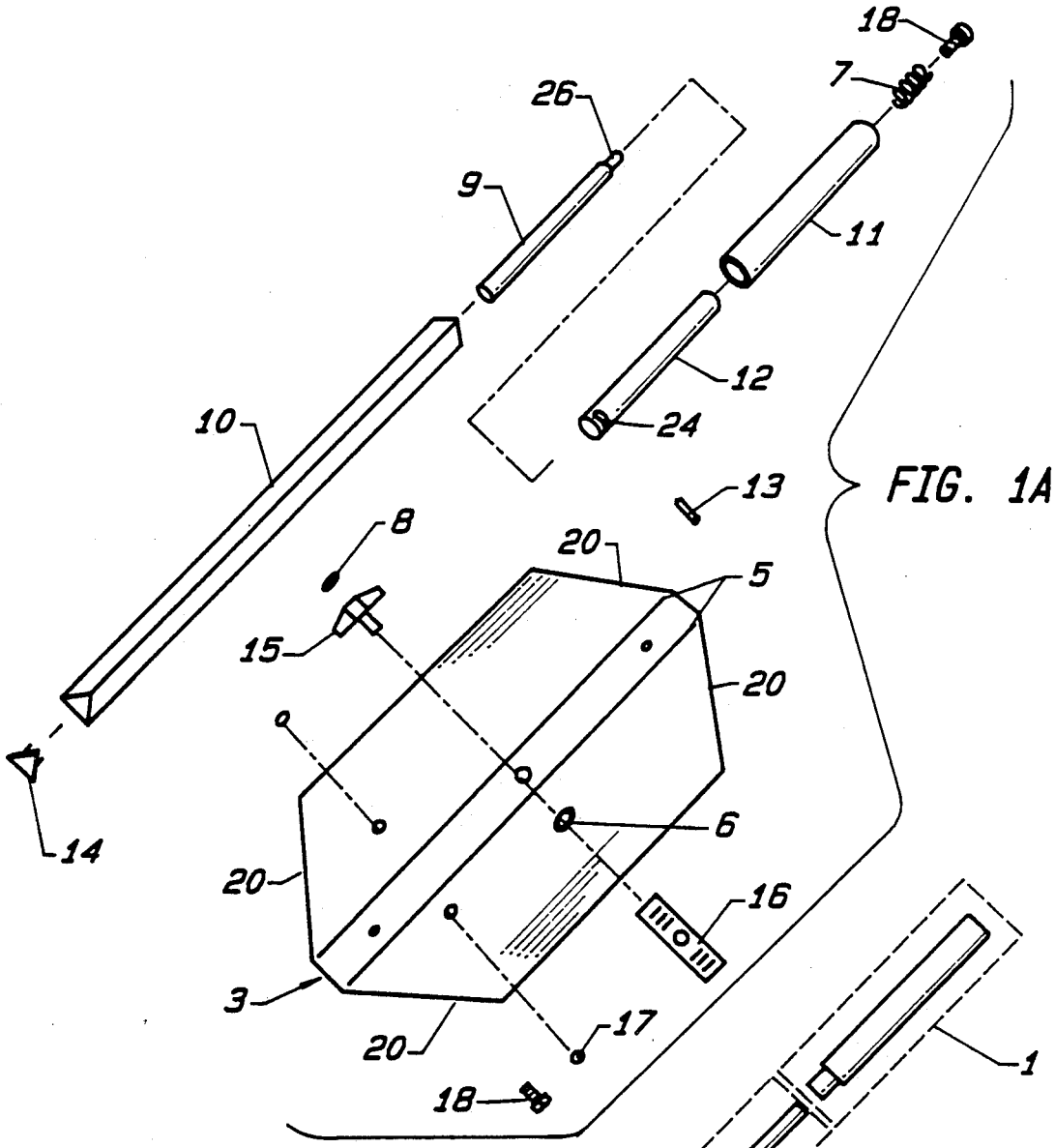
FIG. 1 is an assembly drawing showing the components of a device designed in accordance with the teachings of the instant invention.
Figure 1B:
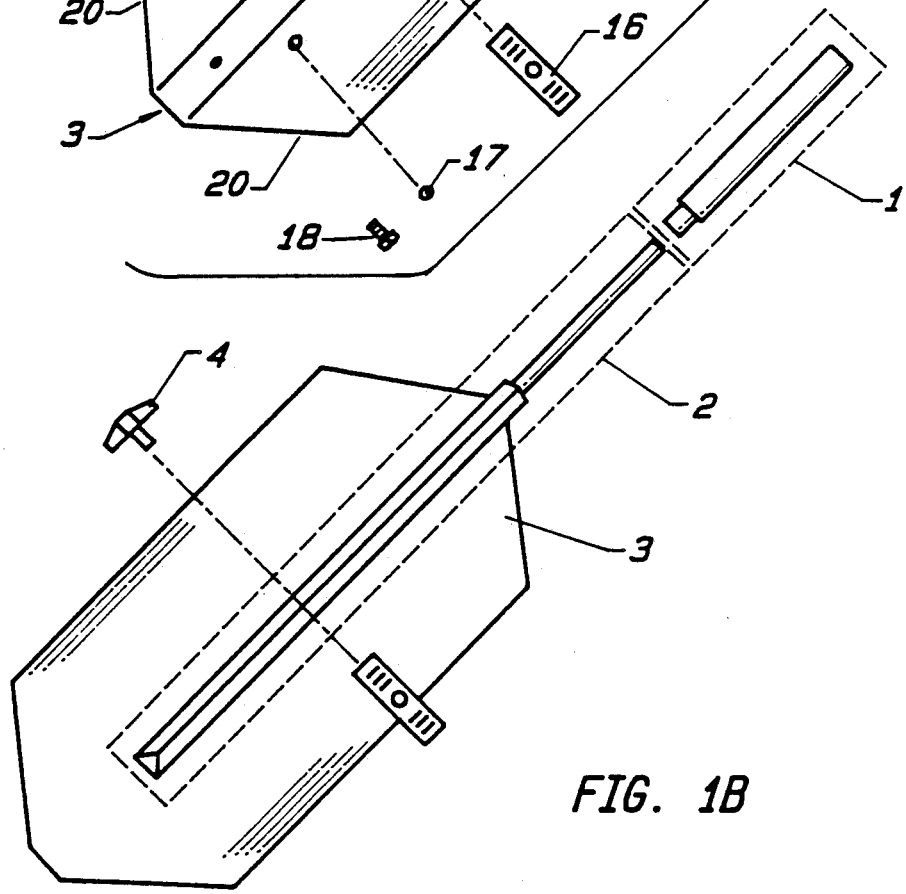
Figure 2A:
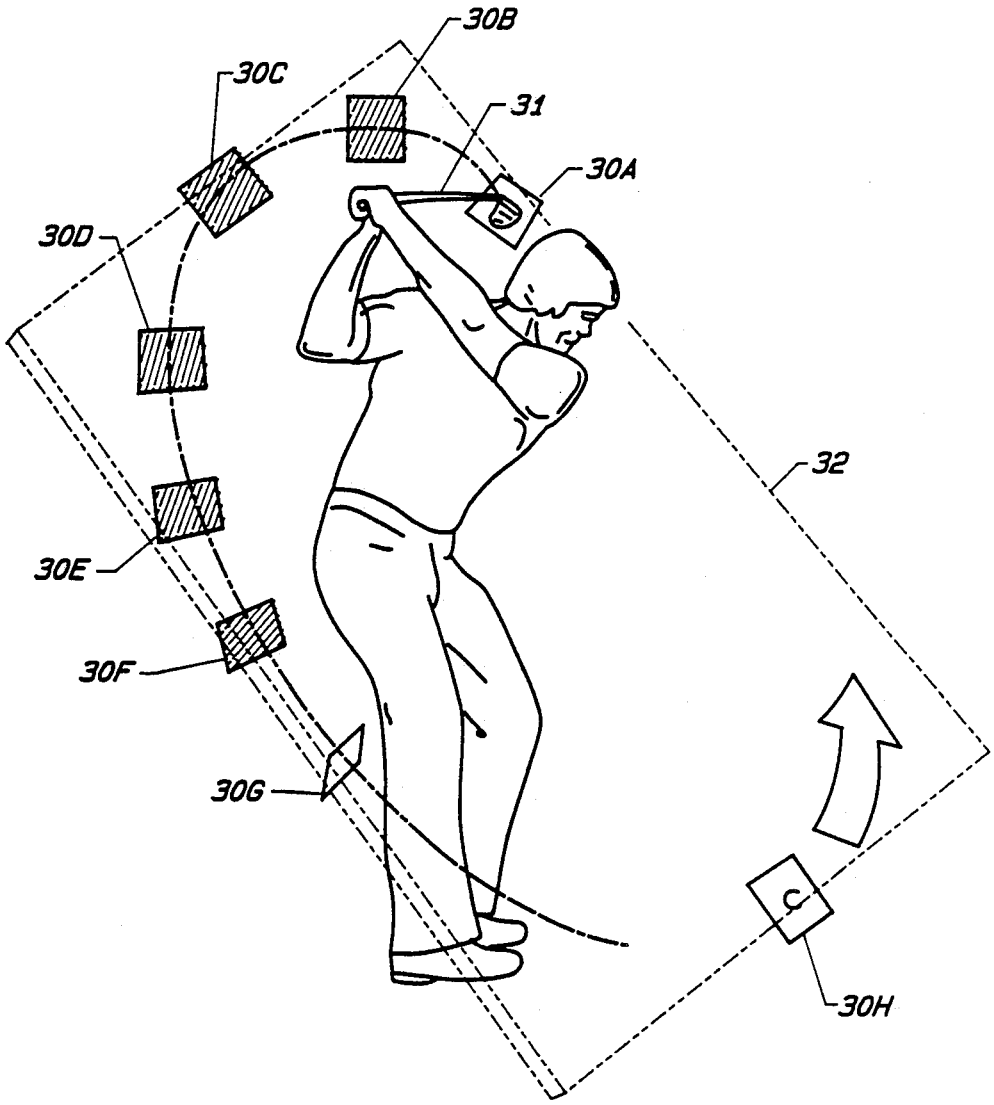
FIG. 2A is an illustration of a golfer's swing motion and dependent swing plane.
Figure 2B:
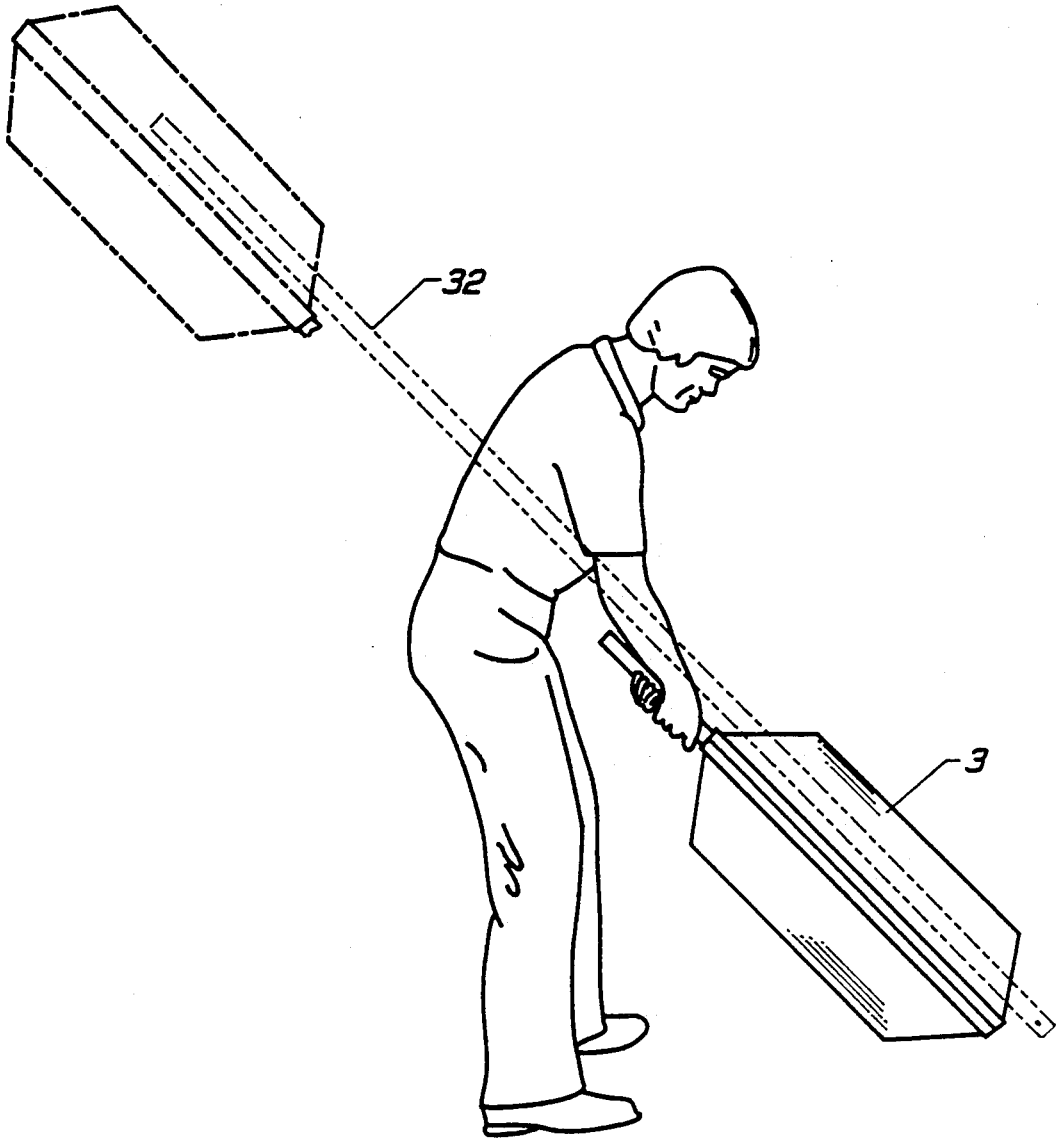
FIG. 2B is an illustration showing the resultant grip and resistance blade attitude (orientation) using a device constructed in accordance with the teachings of the instant invention.

An example of a swing training device in accordance with the present invention is illustrated in the drawings of FIG. 1. Dependent swing motion control is illustrated in FIGS. 2A and 2B.

The main elements of a Swing Trainer according to the teachings of this invention are: The Grip Assembly 1, Support/Body Assembly 2, Blade 3, and optional Blade Lock Assembly 4. Each of the main elements of the device may be broken down into their respective functions according to the features offered to the user. In the case of the Golf Swing Trainer illustrated in FIGS. 1 and 2, the body of the device consists of a wooden, metal or molded plastic piece 10 upon which the foot 14, blade 3, grip assembly 1, and blade lock assembly 4 attach. It is constructed so as to be strong and light weight while retaining a high degree of stiffness and rigidity. The preferred embodiment illustrated (assuming low-volume manufacturing means) has predominantly triangular components for maximum strength and stiffness. The foot 14 is designed to be highly impact and wear resistant and to be replaced periodically, if necessary. This serves to protect the body of the Trainer from abrasion due to accidental impact with the ground or other surfaces.

The blade 3 is the heart of the swing trainer device. Its function is to provide air resistance to the user throughout the swing motion. The blade is formed of an extruded plastic sheet material that incorporates into its structure a hollow core (such as honeycomb, not shown) to provide needed rigidity, light weight and toughness. The blade is shaped to offer substantial air resistance while profiling the golfer's swing and body position. In the preferred embodiment, the corners 20 of the blade 3 are angled to reduce the likelihood and influence of an impact with the ground during said swing motion, and to maintain clearance with the golfer's body. Optional fold seams or creases are shown in the preferred embodiment illustrated in FIG. 1 for unit portability and storage. Two sets of snaps generally indicated at 17 are typically employed to keep the blade folded when not in use or while being transported.

In an embodiment where the fold seams 5 are provided running the length of the blade to allow the blade to be folded for storage, a lock assembly comprising lock handle 4, and blade lock 16 should be engaged during use of the trainer to prevent the collapse of the air resistant blade 5 or bending of the blade 5 which could cause variations in air resistance during use. When the blade 5 is in use, then the blade lock 16 is oriented relative to the fold seams 5 as shown in FIG 1A and IB, so that the blade lock 16 lies across both of the seams and prevents the blade from folding back along the seam lines. When the blade 5 is to be folded for storage, then the handle 15 is rotated 90°, so that the blade lock 16 is also rotated 90° and its long axis now lies parallel to the seams and the blade 5 can be easily folded. The blade lock 16, as turned by handle 15 to lie across the fold seams 5, prevents unevenness in the overall blade profile during any swing. The reinforcement of the blade 5 is important because this minimizes the tendency of the blade to swing outside of the ideal swing plane by maximizing the overall flatness of the blade, and thus minimizing any tendency the blade might have to deviate from the swing plane during use. If sufficient stiffening of the blade is not provided, the resulting change in the profile of the blade as the blade is swung would allow the air to spill to the backside of the blade, causing it to twist in the hands of the user and slice through the air sideways.

Failure to maintain the intended swing plan will result when: 1) the blade 5 assumes a curved or bent profile because of its tendency to bend or fold when air resistance occurs in the backstroke or due to its tendency to close from prolonged periods in the closed condition; 2) when the plastic blade material assumes a bent "set" condition, this bent "set" condition must be overcome by the deployment of the blade lock mechanism to force the blade into a flat blade profile; and 3) if the blade lock is not used, the resulting uneven air resistance across the face of what is not now a non-flat blade profile changes the swing plane trajectory.

A critical feature of the present invention is the spring loaded grip which is attached to the support body assembly 2. The grip includes a grip sleeve 11 which surrounds a shaft 12 which is coupled to spindle 9, the spindle 9 in turn being fastened to the support body assembly 2. A spring 7 and fastener 18 are provided at the end of the shaft 12. The shaft 12 is fastened to the spindle 9 using fastener 13 which is inserted through slot 24 in the shaft 12 and then into the end 26 of spindle 9. One end of the spring 7 is fastened to the shaft 12; the opposite end of the spring is fastened to the spindle 9. By utilizing this arrangement, spring tension is imparted to the spindle from the grip. This spring tension force is asserted against the blade from the grip. As the user swings, the support body assembly 2 of the training device rotates relative to the plane of the swing. The air resistance blade rotates relative to the support body assembly 2, and will remain constantly perpendicular to the swing plate, and therefore impart a constant resistance force to the passage of the blade through the air. When the swing is completed, the spring force rotates the blade back to its starting position relative to the shaft. This operation will be explained in further detail below with reference to FIGS. 2A and 2B.

FIG. 2A breaks the swing motion of a golfer, down into a series of successive illustrations 30A–30H show the striking head of the golf club which rotates relative to the swing plane as the club is swung along the swing plane 32. The objective is to always have the same striking angle between the golf club head and the ball and the point of contact 38 between the club head and the ball. By adopting the construction of the present invention, with the resistance blade floated on the shaft which is gripped by the golfer but is connected by a spring bias member, the blade 3 remains perpendicular to the swing plane throughout the entire stroke. This allows the user shown in FIG. 2A to rotate the shaft of the training device during his stroke as always occurs in the case of a proper golf swing, without creating a significant change of angle outside of the perpendicular one which is achieved between the resistance blade and the plane of the swing. This invention accommodates the natural head angle change found in a normal golf swing, and simply imparts a constant resistance load which is not influenced by the typical change in head angle relative to the swing plane.

The construction illustrated in FIG. 1 allows rotation of the blade and support body assembly during the swing motion. The spring loaded .grip assembly continually exerts in the preferred embodiment a counterclockwise rotational force upon the support body assembly 2 attached to the resistance blade 3 (this counterclockwise rotational force is defined as the rotational direction seen looking down for a right-handed user; the direction of course is reversed in the case of a left-hand user).

In preparing to use the device, (refer to FIG. 2B), the entire body 2 with blade 3 of the device are rotated to a position approximately 45° past the vertical in a counterclockwise direction (again reversed for a left-handed person) when the user assumes a standard golf stance with the flat (not shown) on the grip facing up. At this point with the stance assumed but with the swing not yet begun, the blade 3 will not be perpendicular to the swing plane 32, but will be allowed to freely rotate to achieve a balanced resistance, and will be at a slight angle deviating from perpendicular to the swing plane which will be overcome during the back swing.

When the forward portion of the swing is begun from the top position shown in FIG. 2A, the blade is in its position perpendicular to the swing plane and remains in this perpendicular position throughout the swing, even though the shaft on which the resistance blade 3 is floated, it is rotating relative to the plane. Because of the provision of the bias force by the spring 7, the blade of the trainer rotates to a position perpendicular to the swing plane at all times when sufficient force is applied. If the blade were simply fixed to the shaft, maximum air resistance would only be encountered at approximately the final third of the swing rotation, since this is the only portion of the golf swing where the face of a driving club is predominantly perpendicular to the swing plane as it appears from the successive illustrations in FIG. 2A. Thus if the blade and shaft were rigidly fixed to one another, the blade would tend to slice through the air sideways, developing erratic air resistance and loss of control.

Finally, the need for the grip assembly 1 to be spring loaded as opposed to simply being free floating is that the blade 3 must return to the home position prior to the start of each new stroke. Moreover, constant tension must be maintained on the blade throughout the swing motion. Finally, the spring biasing feature prevents the blade from spinning wildly in an uncontrolled fashion which might cause the entire unit to collide with the ground as well as nullify the benefits attributed to the constant air resistance.

The foregoing description is offered primarily for purposes of illustrating teachings that are adaptable to a variety of sports and dependent training apparatus. It will become readily apparent to those skilled in the art that variations and modifications described herein, as well as alternative expedients and components structural materials and features may be introduced without departing from the spirit and scope of the invention as defined by the claims. For example, the teachings of the device illustrated for golf swing training may also be used to improve the skills of a hockey player or baseball player in conjunction with equipment which incorporates the constant resistance training blade of the present invention. Therefore, the scope of the present invention is to be limited only by the following claims.

What is claimed is:

1. A device for training the swing of an athlete's arm(s) by establishing a constant level of resistance to movement of the arm(s) along a prescribed path comprising a support body having a grip for the user, an air resistance blade physically mounted on but rotationally floated relative to said support body, and a biasing element connecting said support body and said blade, whereby said blade is maintained at a constant angle relative to the path of the swing of the support body.

2. A device as claimed in claim 1 wherein said biasing element comprises a circular spring connecting said support body and said blade and providing a counterclockwise bias to said blade relative to said shaft for a righthanded user of said shaft.

3. A device as claimed in claim 2 including wherein said blade includes fold lines running parallel to the long axis of said blade, and means for supporting said blade so that the blade cannot fold or twist along said lines when said device is swinging.

4. A device as claimed in claim 3 including a locking blade supported perpendicular to the air resistance blade and extending across the fold lines and in front of the direction in which the air resistance blade folds on said fold lines, so that said blade is supported against folding on said lines as said blade is swinging.

* * * * *